US007124825B2

(12) United States Patent
Slack

(10) Patent No.: US 7,124,825 B2
(45) **Date of Patent: *Oct. 24, 2006**

(54) CASING WEAR BAND AND METHOD OF ATTACHMENT

(75) Inventor: Maurice William Slack, Edmonton (CA)

(73) Assignee: Tesco Corporation, Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/480,771

(22) PCT Filed: Jun. 13, 2002

(86) PCT No.: PCT/CA02/00892

§ 371 (c)(1),
(2), (4) Date: Jun. 8, 2004

(87) PCT Pub. No.: WO02/103155

PCT Pub. Date: Dec. 27, 2002

(65) Prior Publication Data

US 2004/0206509 A1 Oct. 21, 2004

(30) Foreign Application Priority Data

Jun. 15, 2001 (CA) ..... 2350681
Jul. 18, 2001 (CA) ..... 2353249

(51) Int. Cl.
*E21B 17/10* (2006.01)

(52) U.S. Cl. ..... 166/378; 166/241.6; 166/242.6; 175/325.5; 29/508

(58) Field of Classification Search ..... 166/241.6, 166/241.4, 241.3, 242.6, 242.1, 378, 380; 29/505–508; 175/325.5, 325.3
See application file for complete search history.

(56) References Cited

U.S. PATENT DOCUMENTS 1,959,367 A 5/1934 Kennedye
2,424,027 A 7/1947 Gist
2,715,552 A 8/1955 Lane (Continued)

FOREIGN PATENT DOCUMENTS

CA 2328190 6/2001

(Continued)

*Primary Examiner*—Hoang Dang
(74) *Attorney, Agent, or Firm*—Bennett Jones LLP

(57) ABSTRACT

A crimpable wear band (105) tool has been invented for installation on casing (6), used in well bore drilling. A wear band (105) is provided having a cylindrical body which when coaxially placed over a pipe and substantially radially inwardly displaced at a plurality of points (i.e. crimped) about the circumference of a section of cylindrical body, attaches to the pipe to create a connection having structurally significant axial and torque load transfer capacity. When crimped according to the methods of the present invention, the load transfer capacity of the connection between the wear band (105) tool and the pipe (6) can be arranged to substantially prevent significant relative movement of the wear band tool on the pipe under loads that may be encountered when using one or more of the pipes as components of a tubular string used for drilling or running the casing in to complete a well bore.

8 Claims, 3 Drawing Sheets

U.S. PATENT DOCUMENTS

| | | | | | |
|---|---|---|---|---|---|
| 3,360,846 | A | | 1/1968 | Schellstede et al. | |
| 3,499,210 | A | | 3/1970 | Schellstede et al. | |
| 3,945,446 | A | | 3/1976 | Otertag et al. | |
| 4,000,549 | A | * | 1/1977 | Brumley et al. | 175/325.5 |
| 4,101,179 | A | * | 7/1978 | Barron | 175/325.5 |
| 4,105,262 | A | | 8/1978 | Richey | |
| 4,245,709 | A | * | 1/1981 | Manuel | 175/325.5 |
| 4,319,393 | A | * | 3/1982 | Pogonowski | 29/434 |
| 4,330,924 | A | * | 5/1982 | Kushner et al. | 29/458 |
| 4,630,690 | A | * | 12/1986 | Beasley et al. | 175/57 |
| 4,868,967 | A | | 9/1989 | Holt et al. | |
| 5,070,597 | A | | 12/1991 | Holt et al. | |
| 5,566,754 | A | * | 10/1996 | Stokka | 166/241.6 |
| 5,961,157 | A | | 10/1999 | Baron et al. | |
| 6,006,830 | A | * | 12/1999 | Barron et al. | 166/241.6 |
| 6,409,226 | B1 | | 6/2002 | Slack et al. | |
| 6,679,335 | B1 | * | 1/2004 | Slack et al. | 166/380 |
| 2004/0231854 | A1 | * | 11/2004 | Slack | 166/378 |

FOREIGN PATENT DOCUMENTS

| | | |
|---|---|---|
| EP | 0 783 074 | 9/1997 |
| WO | WO 02/02904 | 1/2002 |
| WO | WO 02/04783 | 1/2002 |
| WO | WO 02/103154 | 12/2002 |
| WO | WO 02/103156 | 12/2002 |

* cited by examiner

CASING WEAR BAND AND METHOD OF ATTACHMENT

FIELD OF THE INVENTION

The present invention relates to wear bands for casing a method of attachment to enable transfer of structurally significant axial and torsional loads between the wear band and pipe.

BACKGROUND OF THE INVENTION

Within the context of petroleum drilling and well completions, wells are typically constructed by drilling the well bore using one tubular string, largely comprised of drill pipe, then removing the drill pipe string and completing by installing a second tubular string, referred to as casing, which is subsequently permanently cemented in place. The installation of casing, in this typical construction requires that the casing be run into long boreholes, some having horizontal stretches. In these horizontal stretches, the casing must be installed by pushing it along the borehole. In so doing the casing is pushed in engagement with the borehole wall.

Recent advances in drilling technology have enabled wells to be drilled and completed with a single casing string, eliminating the need to 'trip' the drill pipe in and out of the hole to service the bit and make room for the casing upon completion of drilling. This change is motivated by potential cost savings arising from reduced drilling time and the expense of providing and maintaining the drill string, plus various technical advantages, such as reduced risk of well caving before installation of the casing.

However, casing installation through deviated wellbores or by drilling with casing challenge the performance requirements of the casing. Installation can place severe structural demands on casing since they must survive extended periods of time in contact with the borehole wall.

A device is needed to facilitate installation of casing either during a standard run in operation or when the casing is used for drilling.

SUMMARY OF THE INVENTION

A wear band tool has been invented for installation on casing, such as would be useful in well bore drilling and casing operations. The present invention provides a wear band having a cylindrical body which when coaxially placed over a pipe and substantially radially inwardly displaced at a plurality of points (i.e. crimped) about the circumference of a section of the cylindrical body, attaches to the pipe to create a connection having structurally significant axial and torque load transfer capacity. When crimped according to the methods of the present invention, the load transfer capacity of the connection between the wear band tool and the pipe can be arranged to substantially prevent significant relative movement of the wear band tool on the pipe under loads that may be encountered when using one or more of the pipes as components of a tubular string used for drilling or completing well bores.

The pipe on which the wear band tool of the present invention is installed must be capable of accepting the hoop stresses of crimping without becoming unstable, for example, without buckling or crumpling. This generally requires that the pipe be thick-walled, for example, having an external diameter to thickness ratio ("D/t") less than 100 and preferably less than 50.

To be most generally useful for these applications, the wear band tool should be amenable to rapid field installation on joints of pipe having at least one non-upset end. In addition, the wear band tool, once installed should not substantially reduce the minimum diameter (drift diameter) through the pipe.

Thus, in accordance with a broad aspect of the present invention, there is provided a wear band tool comprising: a body having an outer facing surface and an inner bore therethrough sufficiently large to allow insertion therethrough of a selected pipe having an external diameter, at least one tubular section on the body, the portion of the inner bore extending through the tubular section having an internal diameter capable of loosely fitting about the external diameter of the pipe and a bearing surface on the outer facing surface.

The tubular section can be cylindrical or largely cylindrical with some radial variations to the internal diameter or outer surface. The tubular section should be circumferentially continuous such that a hoop stress can be set up by radially inwardly displacement (i.e. crimping) at a plurality of points about the circumference of the outer surface of the section. The tubular section should be capable of accepting the hoop stresses of crimping without becoming unstable, for example, without buckling or crumpling. This generally requires that the section be thick-walled, for example, having an external diameter to thickness ratio ("D/t") less than 100 and preferably less than 50.

The loose fit of the section about the pipe must be sufficient to accommodate the variations of the outer diameter of the pipe intended to be used.

The bearing surfaces can be for example lines of weldments, hard-faced rings etc.

In accordance with the present invention there is also provided, a method to attach a wear band tool to a pipe by crimping, the pipe having an outer surface, such method comprising the steps of: providing a pipe; providing a wear band tool having a body with an inner bore therethrough sufficiently large to allow insertion therethrough of the pipe, a plurality of outward facing bearing surfaces on the body and at least one tubular section on the body having an internal diameter capable of fitting about the outer surface of the pipe; inserting the pipe through the inner bore of the wear band tool, applying an inward, substantially radially-directed force to a plurality of points about an outer circumference of the tubular section causing it to plastically deform inwardly and come into contact with the outer surface of the pipe, applying such additional inward, substantially radially directed force as required to force both the wear band tool and the outer surface of the pipe to displace inwardly an amount at least great enough so that when the force is released, an interference fit is created between the wear band tool and the pipe.

Preferably, the inward, substantially radially directed force is not so great that the drift diameter of the pipe is excessively reduced. Frictional forces enabled by the interference fit at the inwardly displaced section provide the mechanism by which structurally significant axial and torsional load may be transferred between the wear band tool and pipe without slippage therebetween.

The ability of the crimping method to ensure a residual interference fit is dependent on appropriate selection of various parameters as will be apparent to one skilled in the art. Where the application permits, from the point where plastic deformation of the wear band tool induced during crimping has reduced the original loose fit to come into contact with the pipe of the method, differential temperature may be used to control interference according to the well known methods of shrink fitting, whereby the differential temperature is obtained by heating the wear band tool, cooling the pipe, or both, prior to crimping.

However, for the present application it is preferable to avoid the requirement to either heat the wear band tool or cool the pipe as required to obtain interference by shrink fitting. The method provides for sufficient interference in the crimped connection through mechanical means, without requiring a significant temperature differential between the wear band tool and pipe at the time of crimping. This is realized by selecting the elastic limit of the wear band tool material, in the section to be crimped, to be less than that of the pipe on which the wear band tool is to be installed. In this context, the elastic limit generally refers to the strain at which the material of the parts yields. Having the material properties thus selected, it will be apparent to one skilled in the art, that when the radial displacement applied during crimping is sufficient to force the hoop strain of the pipe to be at least equal to its elastic limit, upon release of the load causing the radial displacement, the pipe will tend to radially 'spring back' an amount greater than the wear band tool, were both parts separated. Since the parts are not separated, the difference in this amount of spring back is manifest as interference and fulfills the desired purpose of creating interference by purely mechanical means.

While a purely mechanical method of obtaining interference through crimping is desirable for most applications, the present invention also anticipates applications where thermal and mechanical methods can be combined.

To facilitate the frictional engagement of the crimped wear band tool to the thick-wall pipe the inside surface of the wear band tool, at least over the section to be crimped, or the outer surface of the casing can be provided with a roughened surface finish. In a further embodiment, a friction enhancing material such as a grit epoxy mixture is disposed in the interfacial region of the crimped section. Similarly, various bonding materials can be disposed in the interfacial region prior to crimping to act as glues augmenting the frictional aspects of the connection once their shear strength is developed after setting.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF THE PREFERRED EMBODIMENT

Figure 1:
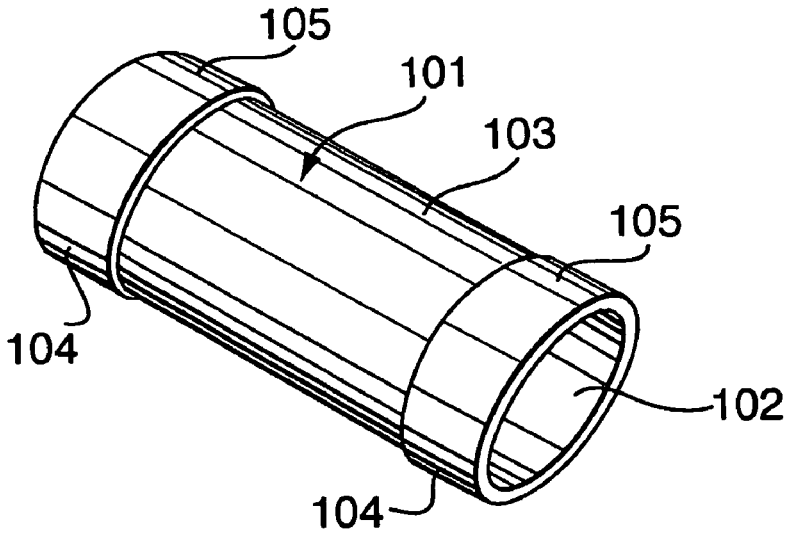
FIG. 1 is a perspective view of a wear band tool according to the present invention.
Figure 2:
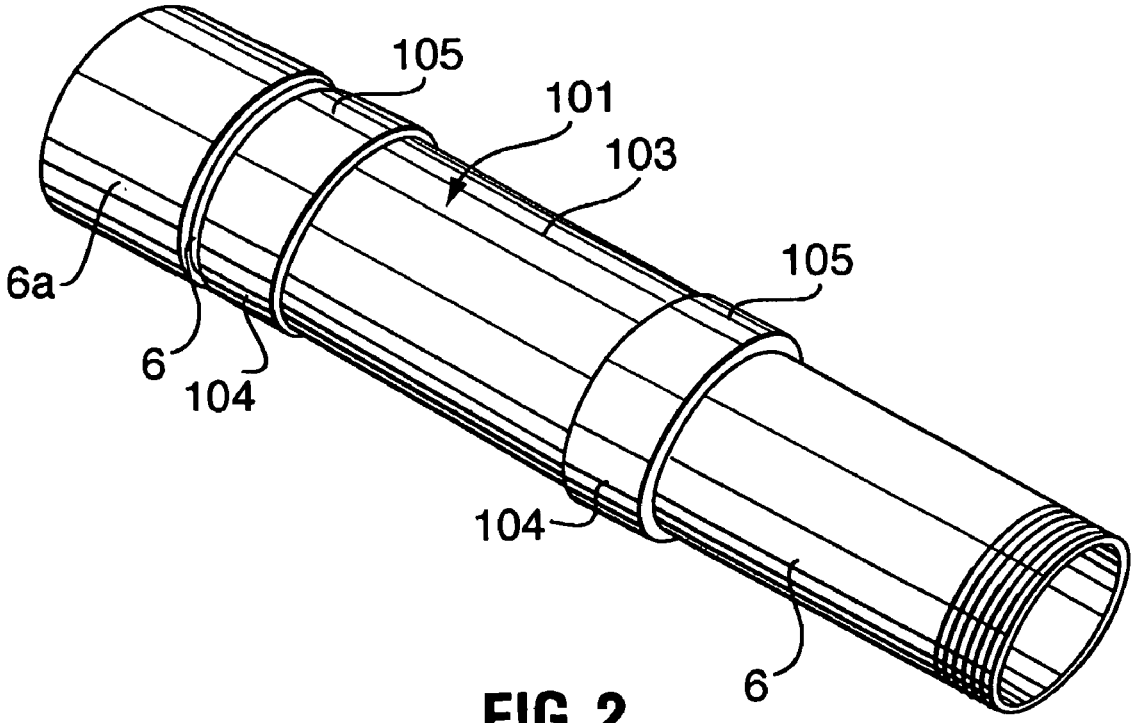
FIG. 2 is a perspective view of the wear band tool shown in FIG. 1 placed on a joint of casing as it might appear before crimping.
Figure 3:
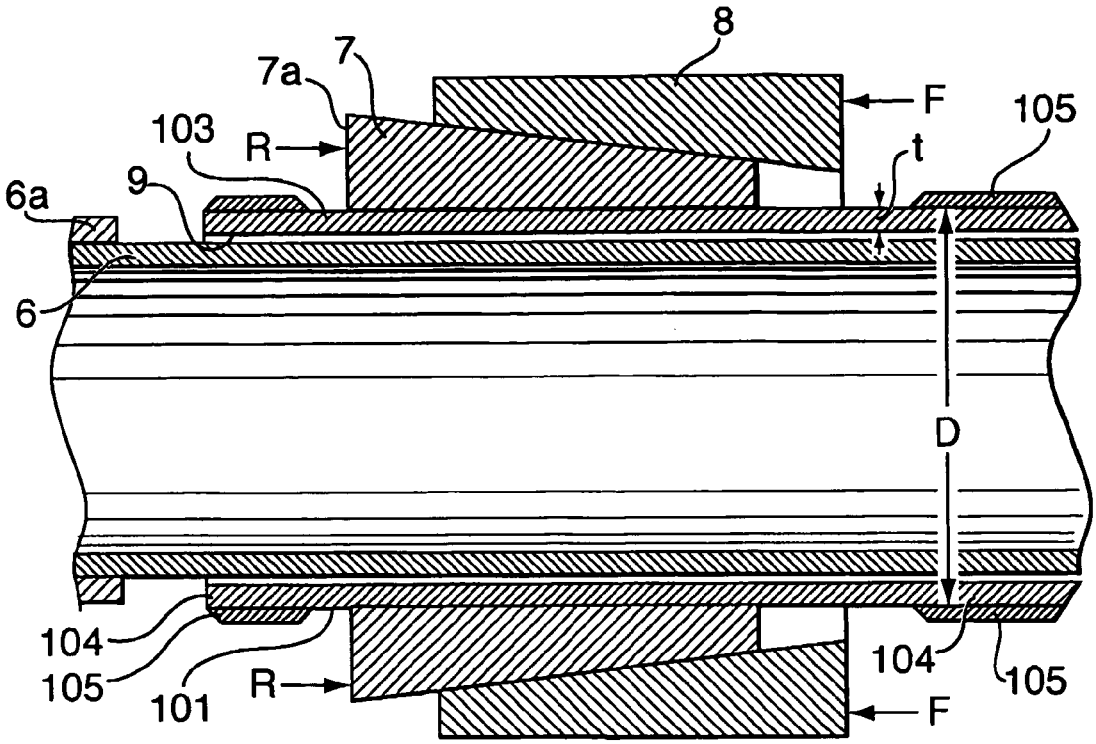
FIG. 3 is a partial sectional schematic view through the wall of a wear band tool positioned coaxially on a casing joint and inside a collet crimping tool prior to application of radial crimping displacement.
Figure 4:
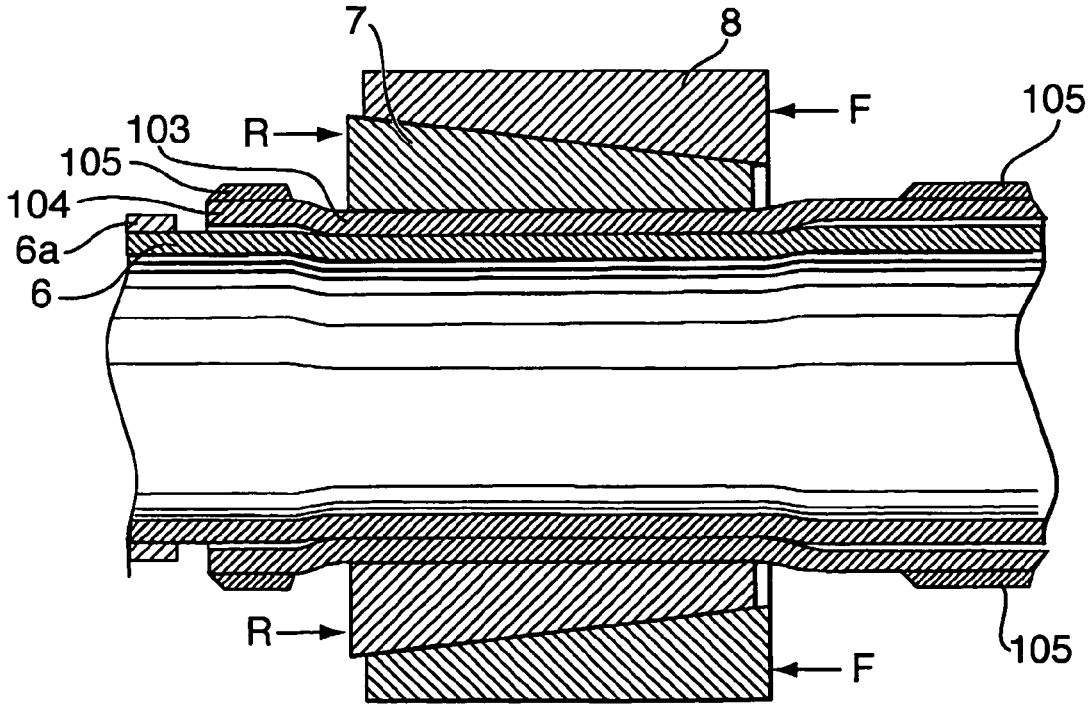
FIG. 4 is the partial sectional schematic view of the assembly shown in FIG. 3 as it would appear after application of radial crimping displacement.

According to the present invention, a wear band tool is provided as shown in FIG. 1, and a method of crimping it to a thick-wall metal pipe when placed on the pipe as shown in FIGS. 2 to 4.

Referring to FIG. 1, a metal body 101 containing an internal bore 102, a cylindrical mid-section 103 forming a section suitable for crimping, and two end intervals 104 on which hard-faced wear bands 105 are placed. As shown, a concentric wear band 105 is placed at each end of the wear band tool forming slightly raised diameter intervals. These wear bands are formed by attaching hard-facing material as commonly known to the industry to metal body 101. The wear bands are selected to act as bearing surfaces and can withstand wear to a greater degree than the remainder of the wear band tool, the casing and casing couplers.

The cylindrical mid section and the end intervals are formed integral on the body and the internal bore passes through all of them. While the crimpable section in the illustrated embodiment is the cylindrical mid-section, it is to be noted that the crimpable section can be formed at one end, if desired. Also, it is to be noted that more than one crimpable section can be provided on the wear band tool, as desired.

Wear bands should be selected with consideration as to the diameter of the borehole in which the wear band tool is to be used, such that the wear bands do not extend the full diameter of the borehole. This provides that the wear bands do not block fluids passing up the annulus between the casing and the borehole wall.

The internal bore 2 of the wear band tool body is selected to loosely fit over at least one end of a casing joint 6 in FIG. 2. As shown, this allows the wear band tool to be readily inserted over an end of the pipe 6 and placed somewhere along the length of the pipe joint prior to crimping. Thus placed, the method of the present invention in its preferred embodiment provides a means to obtain a significant interference fit after crimping even where the wear band tool and casing material are at similar temperatures prior to crimping. In applications where significant heating of the pipe and wear band tool, after wear band tool installation, is anticipated, the wear band tool is preferably selected to have a thermal expansion coefficient that is equal to or less than that of the casing. Similarly in applications where cooling subsequent to crimping is anticipated, the opposite relationship between thermal expansion coefficients is preferred.

Radial displacement required to crimp the wear band tool cylindrical mid-section 103 to the casing joint 6, on which it is placed, may be accomplished by various methods such as by hydroforming, as described in Canadian application 2,328,190, filed Dec. 14, 2000. However, a fixture employing a tapered 'collet in housing' architecture has been found to work well in practice. This method of applying uniform radial displacement, and consequently radial force when in contact with the exterior of a cylindrical work piece surface, employs a device as shown schematically in FIG. 3. The device retains the externally tapered fingers or jaws 7 of a collet (segments of an externally conical sleeve) inside a matching internally tapered solid housing 8. Application of axial setting force to the housing 8, as shown by vector F, which is reacted at the face 7*a* of the collet jaws 7, as shown by vector R, tends to induce the collet jaws 7 to penetrate into the collet housing 8 along the angle of its conical bore. This causes the jaws 7 to move radially inwardly and engage the work piece to be gripped, in the present case, shown as the cylindrical mid-section 103 of a wear band tool. (Alternately, the action of the collet may be described in terms of setting displacement, understood as axial displacement of the collet housing 8 with respect to the collet jaws 7. In this case the setting force is understood to arise correlative with the setting displacement.) The axial force F and reaction R are readily applied by, for example, a hollow bore hydraulic actuator (not shown), arranged with an internal bore greater than the casing 6 outside diameter.

With this arrangement, upon application of sufficient force (F), the jaws may be forced inward to first cause sufficient radial displacement to plastically deform the wear band tool cylindrical mid-section 103 and bring it into contact with the casing 6. This amount of radial displacement removes the annular clearance of the loose fit initially required for placing and positioning the wear band tool on the casing 6. Application of additional setting force then forces both the wear band tool cylindrical mid-section 3, and the underlying wall of the casing 6, inward. In the preferred embodiment, the setting displacement is preferably applied until the hoop strain in the casing wall at the crimp location equals or slightly exceeds its elastic limit. It will be apparent to one skilled in the art that radial displacement beyond this point will cause little increase in residual interference but will have the effect of reducing the drift diameter of the casing joint 6. FIG. 4 schematically shows the collet, wear band tool and casing as they might appear in the fully crimped position. After the desired radial displacement is achieved, the setting displacement of the collet is reversed which releases it from the wear band tool allowing the collet to be removed, leaving the wear band tool crimped to the casing.

To ensure that this method of cold crimping (i.e., mechanical crimping unassisted by thermal effects) results in sufficient residual interference between the wear band tool cylindrical mid-section 103 and the casing 6, in its preferred embodiment the wear band tool material at the cylindrical mid-section 103 has an elastic limit less than that of the casing 6. As is typically the case, the wear band tool and casing material are both made from carbon steel having nearly the same elastic modulii. Therefore, the elastic limit may be expressed in terms of yield strength, since elastic limit is generally given by yield stress divided by elastic modulus.

However, in certain applications it may be desirable to further enhance the load transfer capacity of a wear band tool attached to casing, without increasing the crimped length, by improving the frictional engagement achieved for a given level of interference. While this may be accomplished by various means, roughening one or both of the cylindrical mid-section inner wall or the casing outer surface on which the wear band tool was to be crimped, was found to be particularly effective.

The length of the section crimped will in general linearly affect the load transfer capacity of the crimped connection. For wear band tools attached to full length casing joints, the length of the section suitable for crimping, provided by the cylindrical mid-section 103 may be extended almost without limit. Similarly the length of the collet jaws 7, do not limit length that may be crimped. The collet tool may be used to apply the required radial displacement at multiple axial locations to incrementally crimp an extended length cylindrical mid-section 103. Increased load transfer capacity may thus be readily achieved by increasing the crimped section length.

Figure 5:
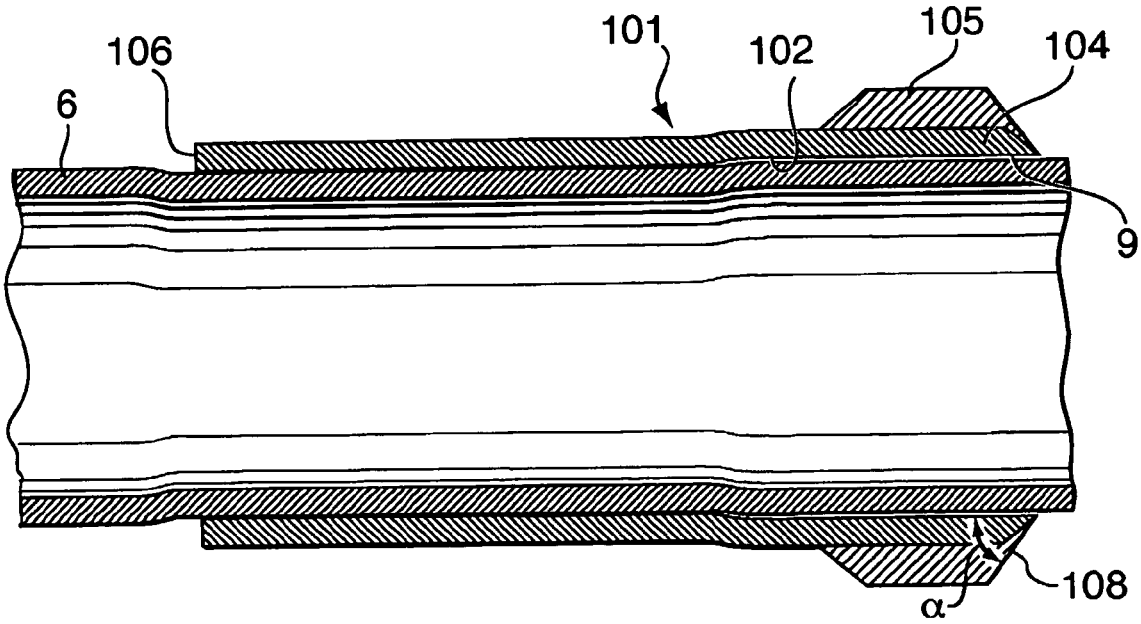
FIG. 5 is an axial sectional view of another wear band tool according to the present invention crimped onto a joint of casing.

Referring to FIG. 5, another wear band is shown crimped on a casing joint. The wear band facilitates installation of casing and includes a metal body 101 containing an internal bore 102, a cylindrical end section 106 forming a section suitable for crimping, and an interval 104 on which a wear band 105 is securely mounted. An end 108 of the wear band tool is ramped to facilitate passage thereover of discontinuities in the borehole. End 108 has a leading edge ramp angle $\alpha$ between the ramped surface and the surface 9 of the inner bore that is selected to ease movement of the casing through the borehole by reducing drag of the casing and casing connections as the casing is advanced through the borehole, especially in horizontal sections, where the casing lies against the borehole wall. Generally, the angle $\alpha$ is selected to be less than about 60° and preferably less than 45° and most preferably less than about 20°. This ramped leading edge is preferably positioned facing downhole to facilitate run in of the casing joint on which it is mounted.

The wear band tool can also be used downhole of a shoulder on the casing, such as a coupling, wherein the ramped leading edge 108 can facilitate passage of the casing through the borehole by preventing the casing shoulder from digging into the formation. The wear band tool can, therefore, be used alone to space the casing from the borehole wall and to accommodate wear, since the wear band 105 will wear preferentially over the shoulder on the casing.

It will be apparent that these and many other changes may be made to the illustrative embodiments, while falling within the scope of the invention, and it is intended that all such changes be covered by the claims appended hereto.

The invention claimed is:

1. A method for attaching a wear band tool to a pipe by crimping, the pipe having an outer surface, such method comprising the steps of: providing a pipe; providing a wear band tool having a body with an inner bore therethrough sufficiently large to allow insertion therethrough of the pipe, at least one outward facing bearing surface on the body and at least one tubular section on the body having an internal diameter capable of fitting about the outer surface of the pipe; inserting the pipe through the inner bore of the wear band tool, applying an inward, substantially radially-directed force to a plurality of points about an outer circumference of the tubular section causing it to plastically deform inwardly and come into contact with the outer surface of the pipe at points corresponding to the plurality of points; and applying such additional inward, substantially radially directed force as required to force both the wear band tool and the outer surface of the pipe to displace inwardly an amount at least great enough so that when released, an interference fit is created between the wear band tool and the pipe.

2. The method of claim 1 wherein at least one of the outer surface of the pipe and an inner surface of the tubular section is roughened to facilitate frictional engagement therebetween.

3. A wellbore casing assembly comprising: at least a section of well bore casing; and a wellbore casing wear band tool crimped onto the at least a section of well bore casing, the wellbore casing wear band tool including: a body having a first end and a second end opposite the first end, an outer facing surface and an inner bore extending therethrough from the first end to the second end sufficiently large to allow insertion therethrough of the external diameter of the well bore casing, at least one crimpable tubular section on the body through which the wellbore casing wear band tool is crimped about the external diameter of the well bore casing and a bearing surface on the outer facing surface.

4. The wellbore casing assembly of claim 3 wherein the bearing surface being selected to withstand wear to a greater degree than the remainder of the wear band tool.

5. The wellbore casing assembly of claim 3 wherein the crimpable tubular section has an external diameter to thickness ratio of less than 100.

6. The wellbore casing assembly of claim 3 wherein the crimpable tubular section has an external diameter to thickness ratio of less than 50.

7. The wellbore casing assembly of claim 3 wherein the crimpable tubular section is circumferentially continuous such that hoop stress can be generated therein.

8. The wellbore casing assembly of claim 3 wherein the bearing surface includes a ramped end.

* * * * *